US006356238B1

(12) United States Patent
Gainor et al.

(10) Patent No.: US 6,356,238 B1
(45) Date of Patent: Mar. 12, 2002

(54) VEST ANTENNA ASSEMBLY

(75) Inventors: Thomas M. Gainor, Stafford, VA (US); Jovan E. Lebaric, Carmel, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/835,782

(22) Filed: Apr. 11, 2001

Related U.S. Application Data

(60) Provisional application No. 60/244,952, filed on Oct. 30, 2000.

(51) Int. Cl.[7] ..... H01Q 1/12
(52) U.S. Cl. ..... 343/718

(58) Field of Search ..... 343/718, 897; 455/100; H01Q 1/12

(56) References Cited

U.S. PATENT DOCUMENTS 4,041,394 A * 8/1977 Pate ..... 455/100

* cited by examiner

*Primary Examiner*—Michael C. Wimer
(74) *Attorney, Agent, or Firm*—Donald E. Lincoln

(57) ABSTRACT

An antenna is formed on a vest by providing a pair of conducting regions on the outer surface. A non-conducting gap separates the conducting regions. A front conducting strip provides an electrical connection between the first and second electrically conducting portions. A feed conductor is connected to a conducting patch that is connected to one of the conducting regions.

24 Claims, 5 Drawing Sheets

VEST ANTENNA ASSEMBLY

This application claims the benefit of U.S. Provisional Application Serial No. 60/244,952, filed on Oct. 30, 2000.

BACKGROUND OF THE INVENTION

1. Field of the invention

This invention is directed to an ultra-wideband man-portable radio antenna that operates in the 30 MHz to 500 MHz frequency range using a single antenna.

2. Description of the Prior Art

Most man-portable communications antennas are of the monopole type. A typical monopole antenna uses a metal wire, a thin surface-metalized rod, or a thin, narrow metal tape and operates against the radio enclosure. Although a monopole antenna is simple and inexpensive to manufacture, it has the following serious deficiencies:

1. Typical wire/rod/tape monopole antennas exhibit a narrow instantaneous bandwidth, on the order of one magnitude lower than the bandwidth of the vest antenna according to the present invention.

2. A monopole has a characteristic visual signature (extending above the operator's head) thus identifying the radio operator and disclosing the operator's location 3. Monopole antennas are vulnerable to entanglement in foliage and damage in urban environments.

4. To prevent the deficiencies listed above, many monopole antennas are deployed on a "need to use" basis meaning that they have to be assembled/set up (unfurled in case of metal tape or assembled out of several sections in case of metalized rods) prior to use and then disassembled for stowage after use, which increases the operator workload and precludes instantaneous establishment of radio communication at any arbitrary instant in time.

5. Multiple monopoles (a monopole set) is required to cover the frequency range of 30 MHz to 500 MHz, increasing the number of items/weight the soldier has to carry and restricting the radio operation to only one frequency band at a time (the one corresponding to the particular monopole selected as the antenna).

6. To reduce the monopole length and/or avoid the use of multiple monopoles for man-portable radios, an antenna tuner is used in conjunction with the monopole to increase the monopole's operational bandwidth but this limits the use of the radio to a "single channel" (narrowband) operation at a time.

SUMMARY OF THE INVENTION

The vest antenna according to the present invention overcomes the foregoing and other deficiencies of the prior art by providing a unique combination that no conventional man-portable antenna has been able to provide. The present invention provides a new approach to man-portable antennas by fully integrating the antenna with the combat wear of a soldier. The vest antenna according to the present invention enables radio operation over a very wide frequency range using an ultra-wideband antenna worn by the radio operator.

It is an object of the invention to provide a man-portable antenna that provides wideband operation capability to provide efficient operation in the entire 30 MHz to 500 MHz frequency range without an antenna tuner.

Another object of the invention is to provide a man-portable antenna that is non-obtrusive and that exhibits no visual signature.

It is an object of the invention to provide a man-portable antenna that is inexpensive to manufacture, operate, and maintain and that adds minimal weight to operator.

Still another object of the invention is to provide a man-portable antenna that provides safety from possible entanglements in high voltage overhead wires;

A further object of the invention is to provide a man-portable antenna that is wearable by the operator through integration with existing items of clothing;

Yet another object of the invention is to provide a man-portable antenna that is formed using existing combat equipment such as a flak vest or a load bearing vest that is used as a base for conducting cloth.

An object of the invention is to provide a man-portable antenna that has extensive application potential for both military and non-military uses.

An object of the invention is to provide a man-portable antenna that has a nearly omni-directional radiation pattern with vertical polarization.

Another object of the invention is to provide a man-portable antenna that requires no set-up for its usage and that is suitable for all-weather antenna operation.

Accordingly, in accordance with the present invention, a man-portable antenna assembly formed on a vest to be worn as an article of clothing comprises first and second electrically conducting portions connected to the vest. A non-conducting band is formed on the vest between the first and second electrically conducting portions. A first conducting strip is arranged in a first portion of the vest to provide an electrical connection between the first and second electrically conducting portions. A second conducting strip is placed in a second portion of the vest and connected to the first electrically conducting portion. A conducting patch is connected to the second electrically conducting portion, and a feed conductor is electrically connected to the conducting patch.

The first and second electrically conducting portions the vest preferably comprise metalized cloth arranged to substantially cover all of the vest except for the non-conducting band.

The first conducting strip preferably extends the full length of the front portion of the vest.

The feed conductor preferably comprises a coaxial cable having its center conductor connected to the conducting patch.

The second conducting strip and the conducting patch preferably are on a back portion of the vest and are separated by the non-conducting band.

The second conducting strip preferably extends between a lower edge portion of the vest and the non-conducting band and the coaxial cable has a shield that preferably is secured to the second conducting strip.

The non-conducting band preferably divides the vest so that the first and second conducting portions have substantially equal areas.

The non-conducting band preferably is formed to have a substantially uniform width of about 2.5 cm.

DETAILED DESCRIPTION OF THE INVENTION

Figure 1:
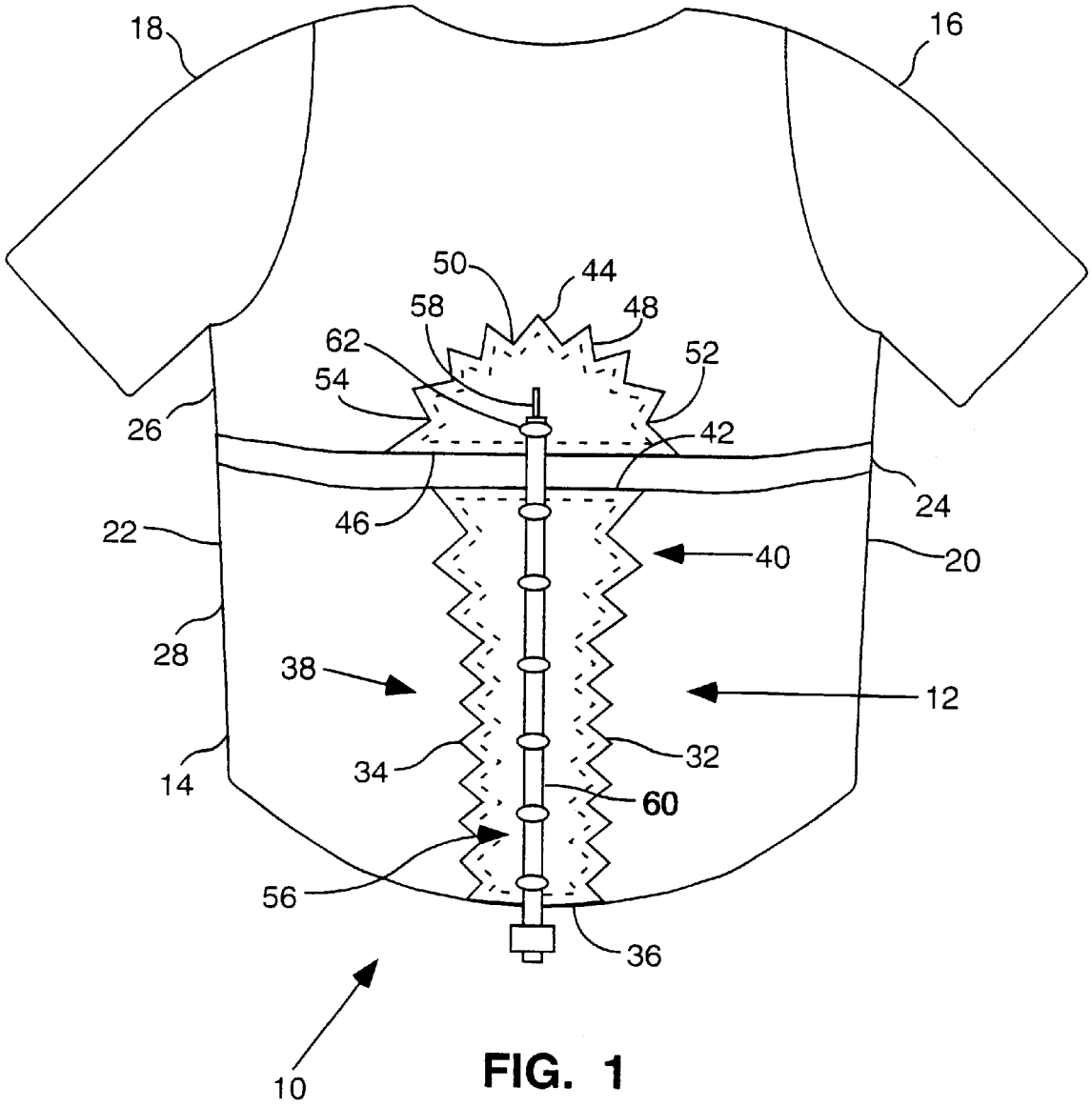
FIG. 1 is a rear elevation view of a vest antenna according to the present invention.
Figure 2:
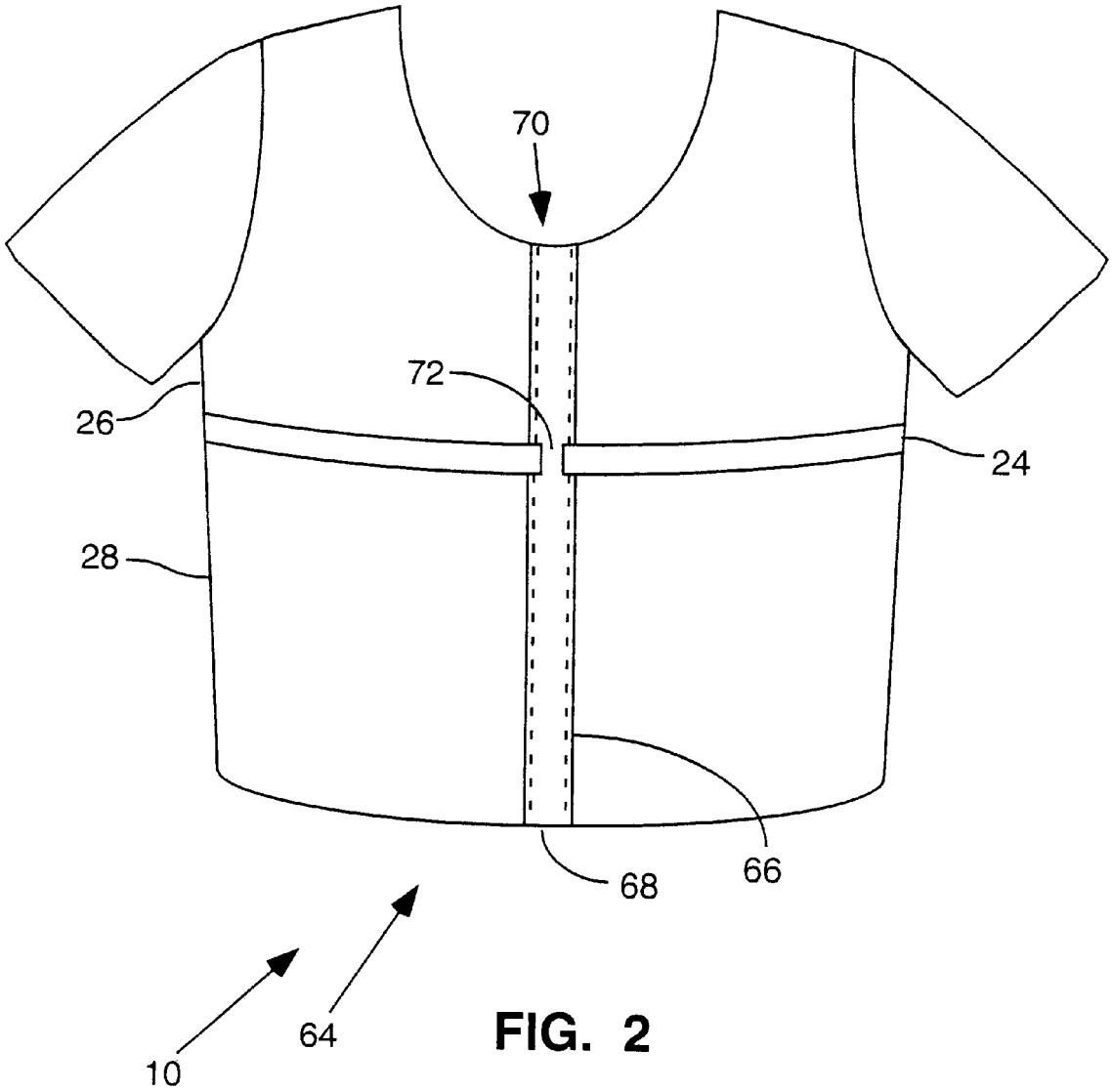
FIG. 2 is a front elevation view of the vest antenna of FIG. 1.

Referring to FIGS. 1 and 2, a vest antenna assembly 10 according to the present invention comprises an antenna structure 12 formed on a vest 14. In a preferred embodiment of the invention. The vest 14 is a military "flak" vest. Military flak vests are well-known devices for protecting the torso of personnel in hazardous situations. A typical flak vest has a height of about 57.5 cm and a width of about 35 cm as viewed in FIGS. 1 and 2. The vest 14 may have curved shoulder regions 16 and 18 and curved side regions 20 and 22 that each have radii of curvature of about 12.5 cm.

The base material for the vest 14 is ordinary cotton duck cloth sewn to the flak vest. The vest antenna assembly 10 includes conducting regions formed of a metalized cloth. Such cloth formed of a copper coated polyester fabric is commercially available from Flectron Metalized Materials of St. Louis, Mo. Any reasonably conducting material can be substituted for the conducting cloth described herein.

A non-conducting band 24 divides the vest antenna assembly 10 into an upper portion 26 and a lower portion 28. The upper portion 26 and the lower portion 28 preferably have equal surface areas to provide optimum electrical performance. The non-conducting band 24 defines a gap that is an integral part of the design. The embodiment of FIG. 1 preferably has a 2.5 cm horizontal gap at the center of the vest 14. The geometry and width of the nonconducting band 24 affect the frequency response and impedance of the vest antenna assembly 10.

Referring to FIG. 1, a conducting strip 30 extends from a central bottom edge portion 32 of the lower conducting half 28 upward to the non-conducting band 24. The conducting strip 30 preferably has "sawtooth" shaped side edges 32 and 34. The conducting strip 30 has a lower edge 36 that preferably has a width of about 15.24 cm. A portion 38 having substantially uniform width extends upward from the lower edge. The width of the portion 38 measured between corresponding "troughs" in the sawtooth configuration preferably is about 9.53 cm. The conducting strip 30 has an upper tapered portion 40 that has an upper edge 42 that preferably has a width of about 17.78 cm adjacent the non-conducting band 24.

Still referring to FIG. 1, a conducting patch 44 is located just above the non-conducting band 24 above the upper edge 42 of the tapered portion 40 of the conducting strip 30. The conducting patch 44 has a lower edge 46 that preferably has a width of 22.86 cm. The conducting patch 44 preferably is formed generally as half an oval having a sawtooth shaped outer edge 48. The conducting patch preferably has an overall height of about 11.43 cm. The distance from the lower edge 46 to the bottom of the uppermost trough 50 in the outer edge 48 preferably is about 8.56 cm. The width between the troughs 52 and 54 that are closest to the lower edge 46 preferably is about 17.15 cm.

Still referring to FIG. 1, the antenna structure 12 includes a coaxial feed cable 56. The coaxial feed cable 56 has a center conductor 58 that preferably is connected to the conducting patch 44 using solder or a conducting adhesive. The coaxial cable 56 has a shield 60 that is connected to the conducting strip 30 on the lower portion 28 of the vest 14. FIG. 1 shows a plurality of solder connections 62 between the conducting strip 30 and the shield 60. The plurality of connections aid in maintaining the integrity of the electrical connection between the feed cable 58 and the conducting patch 44. Flexible coaxial cable is preferred to allow movement of a person wearing the vest 14 without damaging the feed connection. It should be noted that the feed cable may be connected to the conducting strip 30 instead of the patch 44. Copper tape is preferably used to form the patch 44 that functions as a feed region. The copper tape preferably is sewn to the vest material to provide a sturdy, reliable electrical connection to the vest material. Copper tape expands the current from the feed region through a wide region of the conducting outer surface of the vest 14 and improves signal propagation. The copper tape is a generic item that is commercially available at plumbing hardware stores.

Referring to FIG. 2, the upper portion 26 and the lower portion 28 are connected in a front portion 64 of the vest 14 via a conducting strip 66. The conducting strip 66 preferably passes from the lower front edge 68 of the vest to the neck opening 70. A portion 72 of the conducting strip 66 passes over the non-conducting band 24.

Figure 3:
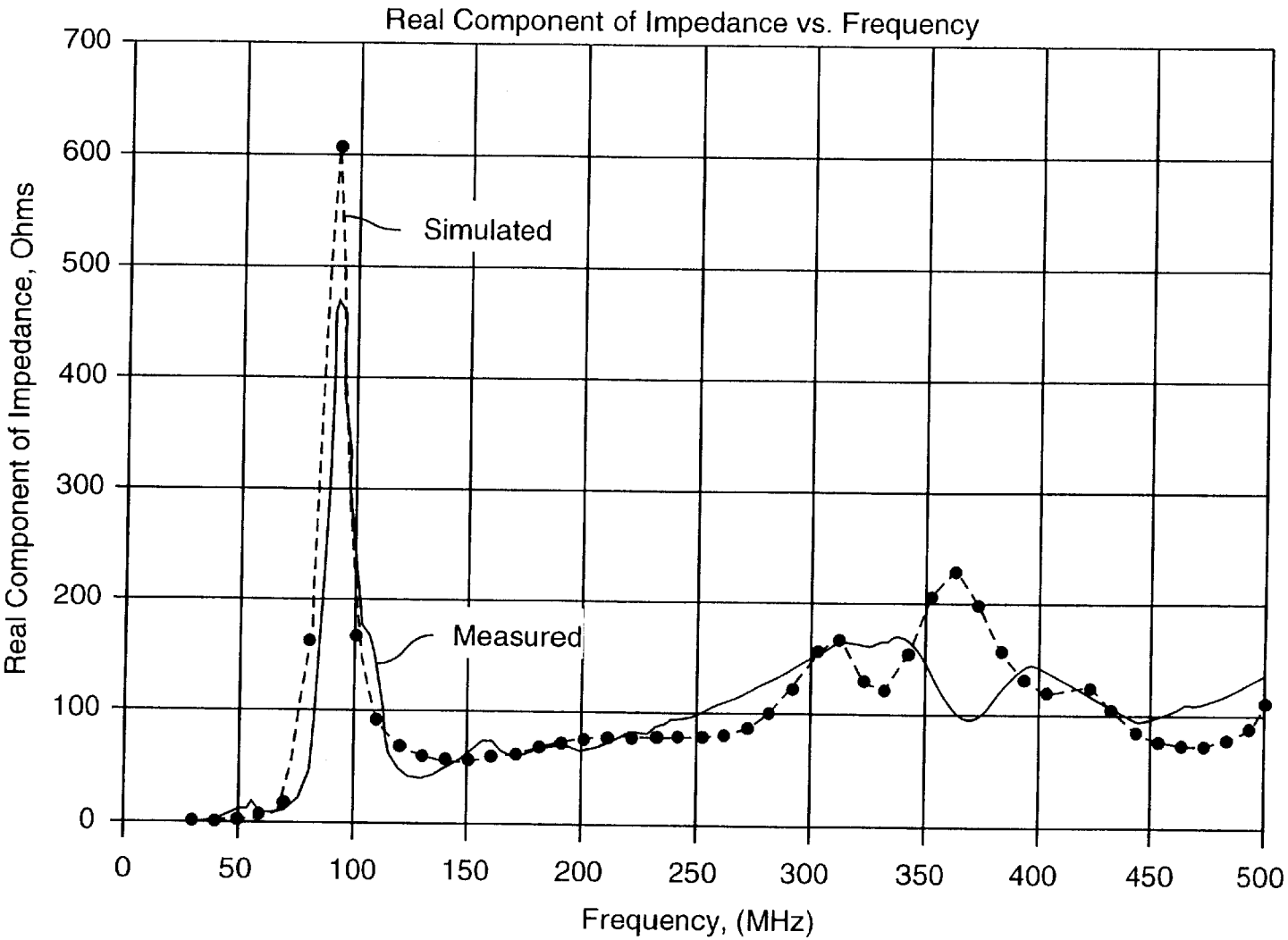
FIG. 3 graphically illustrates the real component of the impedance of the vest antenna as a function of frequency.

FIG. 3 graphically illustrates the real component of the impedance of the antenna structure 12 as a function of frequency. The solid line in FIG. 3 represents measured values of impedance. The dashed line represents impedance data obtained from a computer simulation.

Figure 4:
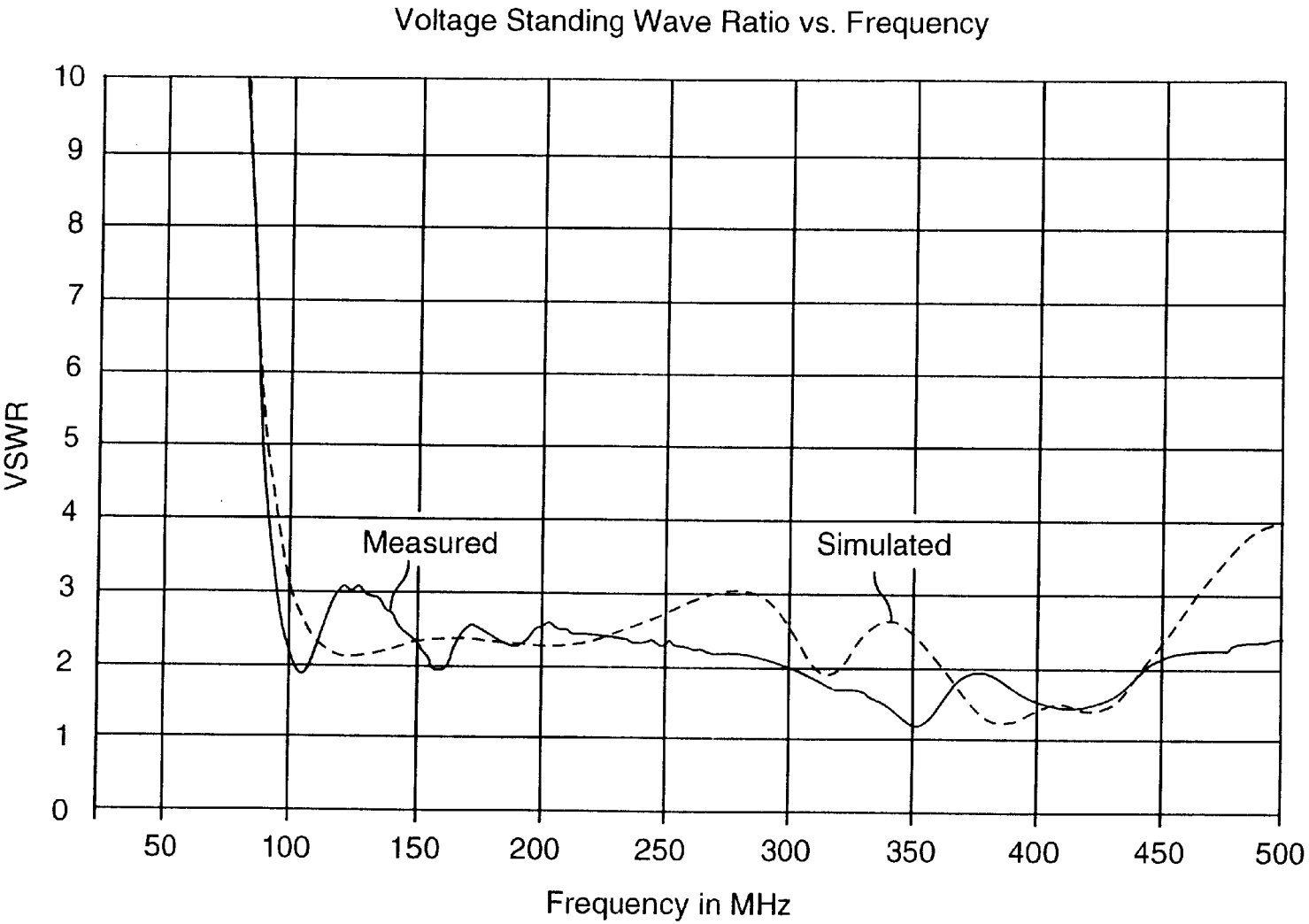
FIG. 4 graphically illustrates the voltage standing wave ratio of the vest antenna according to the present invention as a function of frequency.

FIG. 4 illustrates the voltage standing wave ratio (VSWR) of the antenna structure 12 as a function of frequency. The solid line in FIG. 4 represents measured values of VSWR. The dashed line represents VSWR data obtained from a computer simulation.

Figure 5:
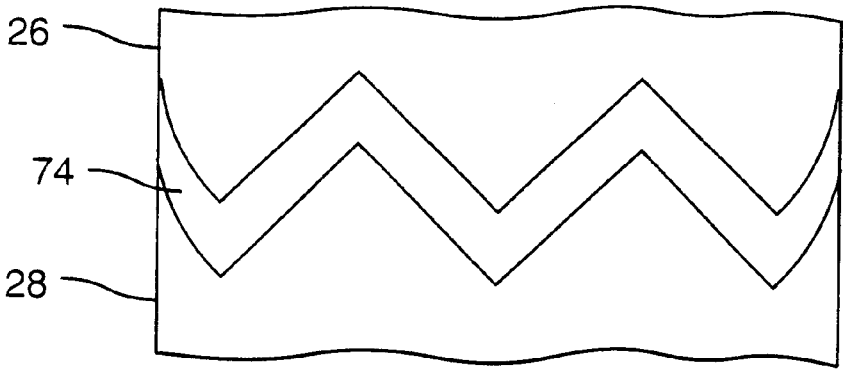
FIG. 5 shows an alternate embodiment of a non-conducting band that is between two conducting portions of the vest antenna according to the present invention.
Figure 6:
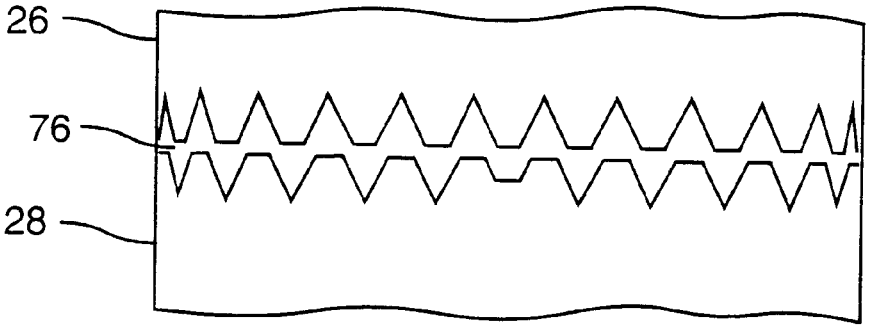
FIG. 6 shows a second alternate embodiment of the non-conducting band.

FIGS. 5 and 6 show alternate configurations for the non-conducting band between the upper and lower regions of the vest 14. FIG. 5 shows a non-conducting band 74 formed in a generally "sawtooth" configuration. The non-conducting band 74 preferably has a width in the range of 2.5 to 5.0 cm.

FIG. 6 shows a non-conducting band 76 having alternating sharply pointed teeth 78 and flattened teeth 80. The pointed teeth 78 may be formed as triangular projections, and the flattened teeth 80 may be formed as frustoconical projections.

Figure 7:
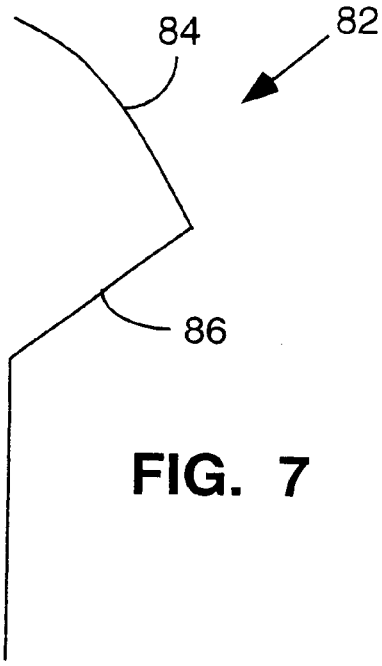
FIG. 7 shows an alternate embodiment of a sleeve that may be included in the vest antenna according to the present invention.

FIG. 7 shows a vest sleeve 82 that has a rounded shoulder portion 84 and a straight portion 86 that extends between the shoulder portion 84 and an upper side portion 88.

The vest antenna assembly 10 according to the present invention has the follow advantages and unique characteristics:

1. Wideband operation capability to provide efficient operation in the entire 30 MHz to 500 MHz frequency range without an antenna tuner
2. Non-obtrusive, exhibiting no visual signature;
3. Inexpensive to manufacture, operate, and maintain;
4. Adds minimal weight to operator;
5. Provides safety from possible entanglements in high voltage overhead wires;
6. Cannot become ensnared or entangled 7. Conducting cloth used as the antenna material;
8. Wearable design through integration with existing items of clothing;
9. Existing combat equipment such as the flak vest or load bearing vest can be used as a base for the conducting cloth;
10. Extensive application potential for both military and non-military uses;
11. Nearly omni-directional radiation pattern with vertical polarization;
12. No set-up required for using the antenna; and
13. All-weather antenna operation.

What is claimed is:

1. A man-portable antenna assembly formed on a vest to be worn as an article of clothing, comprising:

a first portion of an electrically conducting material connected to the vest;

a second portion of an electrically conducting material connected to the vest:

a non-conducting band formed on the vest between the first and second portions of electrically conducting material;

a first conducting strip arranged in a first portion of the vest to provide an electrical connection between the first and second portions of electrically conducting material;

a second conducting strip placed in a second portion of the vest and connected to the first portion of electrically conducting material;

a conducting patch connected to the second portion of electrically conducting material; and a feed conductor electrically connected to the conducting patch.

2. The antenna assembly of claim 1 wherein the first and second portions of electrically conducting material comprise metalized cloth arranged to substantially cover all of the vest except for the non-conducting band.

3. The antenna assembly of claim 2 wherein the first conducting strip is connected to a front portion of the vest.

4. The antenna assembly of claim 3 wherein the first conducting strip extends the full length of the front portion of the vest.

5. The antenna assembly of claim 1 wherein the feed conductor comprises a coaxial cable having its center conductor connected to the conducting patch.

6. The antenna assembly of claim of claim 5 wherein the second conducting strip and the conducting patch are on a back portion of the vest and separated by the non-conducting band.

7. The antenna assembly of claim of claim 6 wherein the second conducting strip extends between a lower edge portion of the vest and the non-conducting band and wherein the coaxial cable has a shield that is secured to the second conducting strip.

8. The antenna assembly of claim of claim 1 wherein the non-conducting band divides the vest so that the first and second conducting portions have substantially equal areas.

9. The antenna assembly of claim of claim 1 wherein the non-conducting band is formed to have a substantially uniform width of about 2.5 cm.

10. The antenna assembly of claim of claim 1 wherein the non-conducting band is formed as a double-edged sawtooth configuration.

11. The antenna assembly of claim 1 wherein the non-conducting band is formed to have alternating triangular projections and frustoconical projections.

12. A man-portable antenna assembly formed on a vest to be worn as an article of clothing, comprising:

an upper electrically conducting region formed of a metalized cloth connected to the vest;

a lower electrically conducting region formed of a metalized cloth connected to the vest:

a non-conducting band formed on the vest between the upper and lower electrically conducting regions;

a front conducting strip arranged in a front portion of the vest to provide an electrical connection between the upper and lower electrically conducting regions;

a rear conducting strip placed in a rear portion of the vest and connected to one of the upper and lower electrically conducting regions;

a conducting patch connected to the other one of the upper and lower electrically conducting regions; and a coaxial feed cable having a center conductor electrically connected to the conducting patch and having a shield connected to the rear conducting strip.

13. A method for forming a man-portable antenna assembly formed on a vest to be worn as an article of clothing, comprising the steps of:

connecting a first portion of an electrically conducting material to the vest;

connecting a second portion of the electrically conducting material to the vest:

forming a non-conducting band on the vest between the first and second electrically conducting portions of electrically conducting material;

placing a first conducting strip in a first portion of the vest to provide an electrical connection between the first and second electrically conducting portions of electrically conducting material;

placing a second conducting strip in a second portion of the vest and connecting the second conducting strip to the first portion of an electrically conducting material;

connecting a conducting patch to the second portion of the electrically conducting material; and arranging a feed conductor to be electrically connected to the conducting patch.

14. The method of claim 13 including the step of forming the first and second portions of electrically conducting material the vest to comprise metalized cloth arranged to substantially cover all of the vest except for the non-conducting band.

15. The method of claim 14 including the step of connecting the first conducting strip to a front portion of the vest.

16. The method of claim 15 including the step of arranging the first conducting strip to extend the full length of the front portion of the vest.

17. The method of claim 13 including the step of forming the feed conductor to comprise a coaxial cable having its center conductor connected to the conducting patch.

18. The method of claim 17 including the step of arranging the second conducting strip and the conducting patch to be on a back portion of the vest and separated by the non-conducting band.

19. The method of claim 18 including the steps of arranging the second conducting strip to extend between a lower edge portion of the vest and the non-conducting band and forming the coaxial cable to have a shield that is secured to the second conducting strip.

20. The method claim of claim 13 including the step of arranging the non-conducting band to divide the vest so that the first and second conducting portions have substantially equal areas.

21. The method of claim 13 including the step of forming the non-conducting band to have a substantially uniform width of about 2.5 cm.

22. The method of claim 13 wherein the non-conducting band is formed as a double-edged sawtooth configuration.

23. The method of claim 13 including the step of forming the non-conducting band to have alternating triangular projections and frustoconical projections.

24. A method for forming a man-portable antenna assembly formed on a vest to be worn as an article of clothing, comprising the steps of:

connecting an upper electrically conducting portion of a metalized cloth to the vest;

connecting a lower electrically conducting portion a metalized cloth connected to the vest:

forming a non-conducting band on the vest between the upper and lower electrically conducting portions;

arranging a front conducting strip in a front portion of the vest to provide an electrical connection between the upper and lower electrically conducting portions;

placing a rear conducting strip in a rear portion of the vest and connecting the rear conducting strip to one of the upper and lower electrically conducting portions;

providing a conducting patch to the other one of the upper and lower electrically conducting portions; and arranging a coaxial feed cable to have a center conductor that is electrically connected to the conducting patch and having a shield connected to the rear conducting strip.

* * * * *